US009466200B2

(12) United States Patent
Berezhnyy et al.

(10) Patent No.: US 9,466,200 B2
(45) Date of Patent: Oct. 11, 2016

(54) WAKE-UP DEVICE

(71) Applicant: KONINKLIJKE PHILIPS N.V., Eindhoven (NL)

(72) Inventors: Igor Berezhnyy, Eindhoven (NL); Pauldy Cornelia Johanna Otermans, Eindhoven (NL); Jonche Dimov, Eindhoven (NL); Ibrahim Mahmoud-Naser, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/653,426

(22) PCT Filed: Dec. 18, 2013

(86) PCT No.: PCT/IB2013/061059

§ 371 (c)(1),
(2) Date: Jun. 18, 2015

(87) PCT Pub. No.: WO2014/097156

PCT Pub. Date: Jun. 26, 2014

(65) Prior Publication Data

US 2015/0348390 A1 Dec. 3, 2015

Related U.S. Application Data

(60) Provisional application No. 61/738,473, filed on Dec. 18, 2012.

(51) Int. Cl.
*G08B 1/00* (2006.01)
*G08B 21/18* (2006.01)
(Continued)

(52) U.S. Cl.
CPC ..... *G08B 21/18* (2013.01); *G04C 21/38* (2013.01); *G04G 11/00* (2013.01); *G04G 13/023* (2013.01)

(58) Field of Classification Search
CPC .... G04C 21/38; G04G 11/00; G04G 13/023; G08B 21/18
USPC ..... 340/309.7
See application file for complete search history.

(56) References Cited

U.S. PATENT DOCUMENTS

2003/0095476 A1 5/2003 Mollicone
2007/0118026 A1 5/2007 Kameyama
(Continued)

FOREIGN PATENT DOCUMENTS

JP 2005270401 A 10/2005
JP 2007054596 A 3/2007
(Continued)

OTHER PUBLICATIONS

PCT International Preliminary Report on Patentability Chapter I: PCT/IB2013/061059, Jun. 23, 2015.*

*Primary Examiner* — Nader Bolourchi

(57) ABSTRACT

A wake-up device (1) comprises clock means (2), wake-up timer means (3), controllable wake-up stimulus means (4), and a control device (5) for controlling the wake-up stimulus means (4). The wake-up stimulus means is capable of varying an intensity of the wake-up stimulus. The wake-up stimulus is started at a relatively low intensity at a predetermined advance time ($t_A$) before the intended time of waking up ($t_{WU}$), in such a manner that the intensity of the wake-up stimulus is gradually increased in accordance with a predefined wake-up program. The wake-up device further comprises sleep quality monitor means (10) for monitoring the quality of the sleep of a user, and for generating a sleep quality monitor signal (S) indicative of the quality of the sleep of the user. The control device is responsive to the sleep quality monitor signal (S) received from the sleep quality monitor means to amend the wake-up program.

15 Claims, 5 Drawing Sheets

(51) Int. Cl.

| | |
|---|---|
| ***G04G 11/00*** | (2006.01) |
| ***G04C 21/38*** | (2006.01) |
| ***G04G 13/02*** | (2006.01) |

(56) References Cited

U.S. PATENT DOCUMENTS

| | | | | |
|---|---|---|---|---|
| 2009/0318776 | A1 | 12/2009 | Toda | |
| 2010/0278016 | A1* | 11/2010 | Sandu | A61M 21/00 368/10 |
| 2011/0160619 | A1 | 6/2011 | Gabara | |
| 2012/0289867 | A1 | 11/2012 | Kasama | |

FOREIGN PATENT DOCUMENTS

| | | | |
|---|---|---|---|
| WO | 2004075714 | A2 | 9/2004 |
| WO | 2007012927 | A1 | 2/2007 |
| WO | 2012073183 | A1 | 6/2012 |

* cited by examiner

WAKE-UP DEVICE

This application is the U.S. National Phase application under 35 U.S.C. §371 of International Application No. PCT/IB2013/061059, filed on Dec. 18, 2013, which claims the benefit of U.S. Provisional Application No. 61/738,473 filed on Dec. 18, 2012. These applications are hereby incorporated by reference herein.

FIELD OF THE INVENTION

The present invention relates in general to a wake-up device for slowly and gently waking up a user by slowly increasing the intensity of a wake-up stimulus. Particularly, the present invention relates to a wake-up light where the stimulus is light. By slowly increasing the light intensity, sunrise is simulated, which gives the user a most natural wake-up experience.

BACKGROUND OF THE INVENTION

Sleep is a physiological process that is commonly described in sleep stages deduced from measurements of brain activity and transition between these stages. One may for instance distinguish the stages of wake, light sleep, deep sleep, and REM (Rapid Eye Movements) sleep. In these stages, the arousal thresholds may differ (i.e. it may be more or less difficult to awaken a person by a certain stimulus), and when a person is made to awaken during these stages the effects on the person's experience of well-being may differ. Especially when a person is made to awaken while in deep sleep (slow-wave sleep, SWS), he may feel groggy and sleepy for some time, and it may take relatively long before this person is actually awake and feeling well. This phenomenon is also known as "sleep inertia".

Sleep inertia is a very well-known problem and is a number one cause of stress during the morning rituals. The effect of sleep inertia is especially severe for persons of so-called late chrono type (also indicated as owls) when compared to those of so-called early chrono type (also indicated as larks). Owls suffer more for two scientifically confirmed reasons:

1) their circadian phase is not optimal for optimal performance in the morning;
2) sleep duration on workdays is shortened because of late sleep onset and early wake times, resulting in sleep deprivations; sleep deprivation in turn is known to result in an increased proportion of deep sleep, which increases the chances that this person needs to wake up from a deeper sleep.

The classical wake-up device is an alarm clock. When he goes to sleep (or at an earlier point in time), the user sets a wake-up time. When the actual time of day becomes equal to the pre-set wake-up time, the alarm clock generates an audible stimulus (sound). When the user is in deep sleep at that moment, chances are that he will suffer from sleep inertia to some degree. Modern prior art wake-up devices such as Philips Wake-Up Light already reduce this problem of sleep inertia by means of introducing an artificial dawn effect.

SUMMARY OF THE INVENTION

Prior art wake-up devices of the type mentioned above do not take into account the stage of sleep of the user: they simply start a predetermined wake-up program at a predetermined time before the set alarm time. So, even though an effect comparable to the natural dawn effect is achieved, it may nevertheless still be that the user is in deep sleep at the alarm time. However, it is a scientific fact that, on average, a person woken up during a stage of light sleep will suffer much less from sleep inertia and will feel less groggy than when the same person is woken up during a stage of deep sleep. Consequently, it is desirable to be woken up during a light sleep stage.

Therefore, the present invention aims to provide a wake-up device capable of increasing the chances that the user is awoken during a stage of light sleep.

One possibility of implementing such a wake-up device would be by real-time monitoring of the sleep stages, and only generating an awakening stimulus when it is confirmed that the user actually is in a stage of light sleep. However, reliable real-time monitoring of sleep stages requires at least a set of three dry electrodes to be attached to the user's head throughout the night, which is uncomfortable for the user.

The present invention involves two important aspects. According to a first aspect of the present invention, the quality of sleep of the user is monitored throughout the night, and the control device calculates an overall relative sleep quality parameter indicating the overall relative quality of sleep during the night. According to a second aspect of the present invention, parameters of the wake-up stimulus program are amended depending on the calculated overall relative quality of sleep.

Specifically, the present invention provides a wake-up device comprising:

clock means for generating an actual time signal corresponding to an actual time of day;

wake-up timer means for generating a wake-up time signal corresponding to an intended time of waking up;

controllable wake-up stimulus means for generating at least one wake-up stimulus for causing a user to wake up, the wake-up stimulus having at least one variable stimulus quantity, wherein a wake-up effectiveness of the wake-up stimulus depends on a value of the stimulus quantity;

a control device having inputs coupled to receive the actual time signal and the wake-up time signal and adapted to generate a control signal for controlling the wake-up stimulus means;

wherein the wake-up stimulus means is responsive to said control signal to vary the value of said stimulus quantity;

and wherein the control device is adapted to generate the control signal such that the wake-up stimulus is generated in accordance with a predefined wake-up program, the wake-up program including:

a) an initial value for the stimulus quantity of the wake-up stimulus, the initial value having a relatively low wake-up effectiveness;
b) an end value for the stimulus quantity of the wake-up stimulus, the end value having a relatively high wake-up effectiveness;
c) a wake-up duration $t_\Delta$, defining an advance time $t_A$ before the intended time of waking up $t_{WU}$ according to the formula $t_A = t_{WU} - t_\Delta$;
d) wherein, at the advance time, the wake-up stimulus is started with the said stimulus quantity having said initial value;
e) wherein, in a time interval from the advance time until the intended time of waking up, the value of said stimulus quantity is gradually varied from said initial value to said end value;
f) wherein, at the intended time of waking up, said stimulus quantity has said end value;

wherein the wake-up device further comprises sleep quality monitor means for monitoring a quality of the sleep of a user and for generating a sleep quality monitor signal indicative of the quality of sleep of the user;

and wherein the control device is responsive to the sleep quality monitor signal received from the sleep quality monitor means to calculate an overall sleep quality parameter of the user and to amend the wake-up program as a function of the overall sleep quality parameter.

Thus, the present invention tailors the waking-up process to a specific user, adapting properties of wake-up stimuli to current night's sleep quality and consequently providing the user with an even better wake-up experience.

Further advantageous elaborations are mentioned in the dependent claims.

It is advantageous if the wake-up device further comprises a memory associated with the control device, which memory contains information defining at least one program parameter of the wake-up program, and wherein the control device is responsive to the sleep quality monitor signal to amend the value of said program parameter as a function of the overall sleep quality parameter.

A preferred program parameter to be amended as a function of the overall sleep quality parameter of the user is said initial value and/or said end value and/or said wake-up duration.

In a particularly preferred embodiment, the memory contains a standard time value $t_{\Delta 0}$ for the wake-up duration $t_{\Delta}$, and the control device is responsive to the sleep quality monitor signal to increase the wake-up duration $t_{\Delta}$ to a value $t_{\Delta 1}$ higher than the standard time value $t_{\Delta 0}$ when the overall sleep quality parameter corresponds to a bad night's sleep of the user.

In a particularly preferred embodiment, the memory contains a standard time value $t_{\Delta 0}$ for the wake-up duration $t_{\Delta}$, and the control device is responsive to the sleep quality monitor signal to reduce the wake-up duration $t_{\Delta}$ to a value $t_{\Delta 2}$ lower than the standard time value $t_{\Delta 0}$ when the overall sleep quality parameter corresponds to a good night's sleep of the user.

In a particularly preferred embodiment, the memory contains a standard stimulus value for the end value of said variable stimulus quantity of the wake-up stimulus, and the control device is responsive to the sleep quality monitor signal to reduce said end value to a value lower than the standard stimulus value when the overall sleep quality parameter corresponds to a bad night's sleep of the user.

In a particularly preferred embodiment, the memory contains a standard stimulus value for the end value of said variable stimulus quantity of the wake-up stimulus, and the control device is responsive to the sleep quality monitor signal to increase said end value to a value higher than the standard stimulus value when the overall sleep quality parameter corresponds to a good night's sleep of the user.

In a particularly preferred embodiment, the wake-up stimulus is light. Light has proved to be a very suitable wake-up stimulus.

In a particularly preferred embodiment, said variable stimulus quantity of the wake-up stimulus is a stimulus intensity. Slowly increasing the intensity of the wake-up stimulus will contribute to the desired effect of gently taking the user out of a deep sleep condition without causing a shock effect. When the wake-up stimulus is light, slowly increasing the light intensity will simulate a natural dawn effect and will thus contribute to a natural way of awakening.

In a particularly preferred embodiment, the sleep quality monitor means include a movement sensor for detecting body movement of the user, and the sleep quality monitor means are configured for generating the sleep quality monitor signal, based on the amount of body movement of the user. It has been found that, on the one hand, body movement is a reliable indication of the level of sleep of a person, while, on the other hand, reliable body movement sensors are commercially available at relatively low cost.

In a particularly preferred embodiment, the memory contains information defining a weighting function as a function of time or as a function of epoch during the night, the weighting function having higher weighting values in earlier stages of the night and lower weighting values in later stages of the night. When body movement measurement signals are weighted using such a weighting function, the experimental result is that a good and natural night's sleep includes periods of deep sleep during the first half of the night.

In a particularly preferred embodiment, the control device is configured to calculate the overall sleep quality parameter as the running summation of weighted measurement samples ($WS(t_i)$) according to the formula $$SQ = \sum_{i=1}^{N} WS(t_i) = \frac{1}{N}\sum_{i=1}^{N} NSD(t_i)\cdot S(t_i)$$

wherein $S(t_i)$ indicates the sampled value of the sleep quality monitor signal (S) in an i-th epoch, and $NSD(t_i)$ indicates the corresponding weighting function. In such a case, it is advantageous if, at a predefined decision time $t_D$, earlier than a standard advance time, the control device increases the wake-up duration $t_{\Delta}$ if at that time the control device finds that a sleep quality decision parameter $SQ(t_D)$ calculated as:

$$SQ(t_D) = \frac{1}{N}\sum_{t=t_1}^{t_D} NSD(t_i)\cdot S(t_i)$$

is higher than a reference value stored in the memory.

Preferably, this reference value is a running average of overall sleep quality parameters or sleep quality decision parameters calculated during a predefined number of previous monitoring sessions. This has the advantage of better tailoring the definition of "good sleep" and "bad sleep" to the specific user.

In a particularly preferred embodiment, the wake-up stimulus means comprises a wake-up lamp with a variable light intensity.

BRIEF DESCRIPTION OF THE DRAWINGS

These and other aspects, features and advantages of the present invention will be further explained by means of the following description of one or more preferred embodiments with reference to the drawings, in which same reference numerals indicate same or similar parts, and in which.

DETAILED DESCRIPTION OF THE INVENTION

Figure 1:
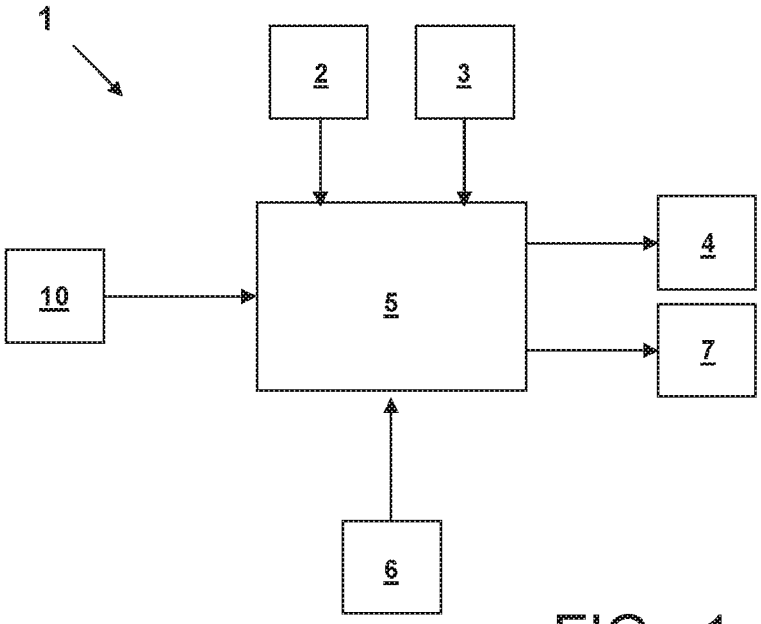
FIG. 1 is a block diagram schematically illustrating a wake-up device according to the present invention.

FIG. 1 schematically shows a wake-up device 1 comprising a controllable wake-up stimulus means 4 for generating at least one wake-up stimulus for causing a user to wake up. The wake-up stimulus means 4 is capable of varying an intensity of the wake-up stimulus. In a specific embodiment, the wake-up device 1 is a wake-up light and the wake-up stimulus means 4 comprises a lamp, capable of generating a light output whose intensity can be controlled within an intensity range between a minimum intensity value equal to or close to zero and a nominal intensity, and the invention will hereinafter be specifically explained for this embodiment. Since such wake-up lights are known per se, a further discussion of the design and functioning of the wake-up stimulus means 4 is omitted here. However, it is noted that the word "lamp" here is used to indicate any type of light source, including LED, and including a plurality of light sources of the same or a mutually different type.

Figure 2:
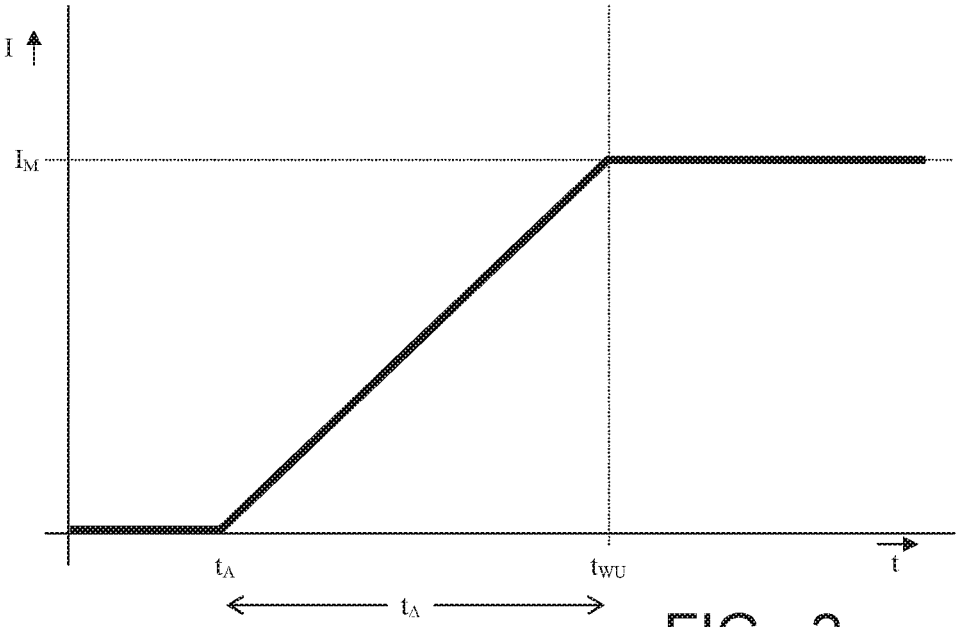
FIG. 2 is a graph schematically illustrating the operation of a wake-up device.

The wake-up device 1 further comprises a control device 5 adapted to generate a control signal for controlling the wake-up stimulus means 4. Specifically, the control device 5 controls the light intensity of the lamp 4 as a function of time, as illustrated in the graph of FIG. 2, in which the horizontal axis represents actual time and the vertical axis represents the output light intensity I of the lamp 4. The control device 5 may for instance be implemented as a suitably programmed microprocessor, microcontroller, digital signal processor, or the like, and will hereinafter also simply be indicated as "controller".

The wake-up device 1 comprises a wake-up timer means 3 for generating a wake-up time signal indicating the intended time of waking up. This intended time of waking up, also indicated as "alarm time", is indicated as $t_{WU}$ in FIG. 2. The wake-up timer means 3 is associated with a user interface to allow the user to set the alarm time, but this is not illustrated for sake of convenience.

The wake-up device 1 comprises a clock means 2 for generating an actual time signal indicating actual time of day, indicated as t in FIG. 2. The clock means 2 is also associated with a user interface to allow the user to set the clock, but this is likewise not illustrated for sake of convenience.

The controller 5 has an input coupled to an output of the clock means 2 to receive the actual time signal, and has an input coupled to an output of the wake-up timer means 3 to receive the wake-up time signal. It is noted that the controller 5, the wake-up timer means 3 and the clock means 2 may be integrated in a single component.

The wake-up device 1 further comprises a memory 6 associated with the controller 5, which memory also may be integrated with the controller 5, and which contains information defining at least one wake-up program. This information may for instance be present in the memory in the form of a formula, and/or a table, and/or coefficients of a polynome. In an embodiment, the memory is associated with a user interface to allow the user to adapt the wake-up program(s), but this is not illustrated for sake of convenience.

The wake-up device 1 further comprises an alarm device 7, controlled by the controller 5. The alarm device 7 is designed to generate an alarm signal intended to immediately wake up the user. In this respect, the alarm device 7 corresponds to the classic alarm clock, and indeed the alarm signal typically involves a sound signal. While it is possible that the intensity and type (beeper, music) of the alarm signal can be selected and set by the user, and while it can be said that the alarm signal itself is the ultimate wake-up stimulus, the terminology "wake-up stimulus" in the context of the present invention will be reserved to indicate the stimulus generated before the alarm time or intended wake-up time. After the alarm time or intended wake-up time, a signal will be indicated as alarm signal.

The operation is as follows. During the night, the lamp 4 is normally off, indicated as intensity zero in the left-hand part of the graph. When the actual time t becomes equal to a certain advance time $t_A$, the controller 5 switches on the lamp 4 at an initial intensity. While the exact value of this initial intensity is not essential to execute the present invention, this initial intensity will normally be low in practice, typically almost equal to zero, and may in fact be equal to zero. The precise timing of advance time $t_A$ is determined by the controller 5 on the basis of the information in memory 6: typically, for each wake-up program, this memory will contain information defining a standard value $t_{\Delta 0}$ for the duration $t_\Delta$ of the time interval from advance time $t_A$ to wake-up time $t_{WU}$, and the controller 5 will calculate a standard value $t_{A0}$ for the advance time $t_A$ according to the formula $t_{A0}=t_{WU}-t_{\Delta 0}$. In the following, this duration $t_\Delta$ will also be indicated as "wake-up duration". A practical standard value for this wake-up duration may be about 30 minutes.

In the time interval between the advance time $t_A$ and the wake-up time $t_{WU}$, the controller 5 gradually increases the output light intensity I of the lamp 4, until a predefined end value $I_{M0}$ is reached at the wake-up time $t_{WU}$. This end value is a maximum in the wake-up interval. While the exact value of this maximum $I_{M0}$ is not essential to execute the present invention, this maximum $I_{M0}$ may be lower than the nominal light output of the lamp 4, or may be equal to the nominal light output of the lamp 4. By "nominal" light output is meant the light output in case the lamp is supplied with the nominal current or voltage corresponding to the rating of the lamp. It is also possible that this end value $I_{M0}$ can be set by the user. It is alternatively or additionally possible that the memory 6 contains information defining this end value $I_{M0}$ for each wake-up program.

The rate of intensity increase may be constant, as illustrated by the straight line between $t_A$ and $t_{WU}$ in the graph of FIG. 2. However, it is also possible that the intensity increase is controlled in accordance with a predetermined formula, also stored in the memory 6, which may for instance be a logarithmic formula, taking the sensitivity characteristics of the human eye into account.

This steady increase of light intensity has the purpose of gently causing the user to shift from deep sleep to light sleep, or to a "close to waking" stage. It may even be that the user actually wakes up before the set wake-up time $t_{WU}$. In that case, the user may actuate a button (not shown) which deactivates the alarm signal.

When the actual time t becomes equal to the wake-up time $t_{WU}$, and the user has not indicated that he is already awake, the controller 5 will actuate the alarm device 7 to generate the alarm signal, but this is not illustrated in FIG. 2. The controller 5 may hold the output light intensity I of the lamp 4 constant, as illustrated. The controller 5 may eventually switch off the lamp automatically, or this may be left to the user.

The operation as described above is the same as the operation of prior art devices, which do not take into account whether the user has had a good night's sleep or a bad night's sleep. The inventive device 1 additionally comprises sleep quality monitor means 10, generating a sleep quality monitor signal S that is received by the controller 5. Based on the received sleep quality monitor signal, the controller 5 calculates an overall sleep quality parameter indicating the overall quality of sleep during the night.

Experiments have shown that, for a normal healthy individual, a normal sleep pattern involves more episodes of deeper sleep in the first half of the sleep period as compared to the second half, while at the end of the sleep period, i.e. during the normal wake-up period, there are few, if any, such episodes of deeper sleep. Experiments have also shown that, in the case of a bad night's sleep, there is an increased probability that the user will have episodes of deeper sleep in the second half of the sleep period, and even during the normal wake-up period, so that there is an increased probability that, at the intended wake-up time $t_{WU}$, the user is in a deep sleep and suffers from sleep inertia when he finally wakes up.

Based on these findings, the present invention provides that, if it is determined that the user has had a normal or good night's sleep, the original wake-up program may be used, but if it is determined that the user has had a bad night's sleep, the user is woken up more gently, over a longer wake-up interval. On the other hand, if it is determined that the user has had a good night's sleep, it is possible that the duration of the wake-up interval is reduced and the wake-up stimulation is intensified.

Thus, according to the invention, the controller 5 is adapted to change the wake-up duration $t_\Delta$ in response to the calculated overall sleep quality parameter: the more the overall sleep quality parameter indicates a bad night's sleep, the more the wake-up duration $t_\Delta$ is increased by the controller 5.

Figure 3B:
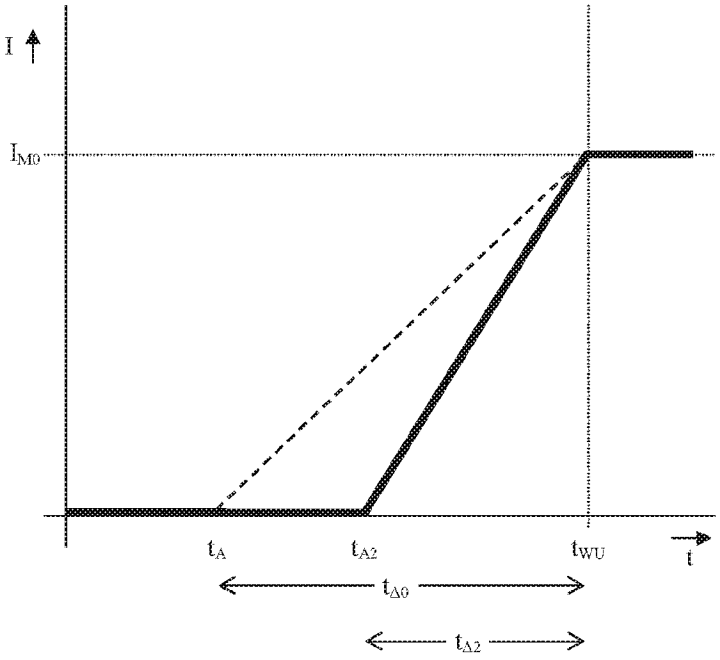
FIGS. 3A and 3B are graphs schematically illustrating amendment of the wake-up interval according to the present invention.
Figure 3A:
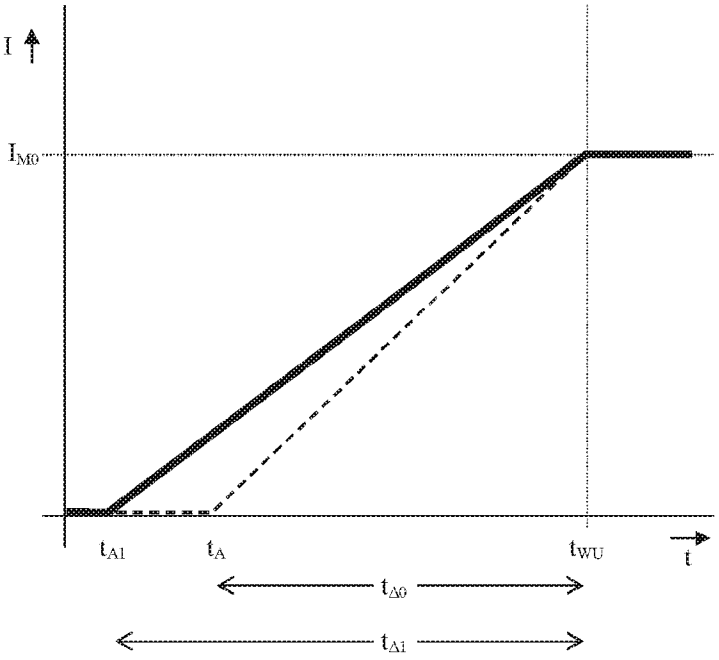

FIG. 3A is a graph comparable to FIG. 2, illustrating the effect of the present invention for a case where the controller 5 finds that the user has had a bad night's sleep. The controller 5 changes the duration of the wake-up interval to a value $t_{\Delta 1}$, which is larger than the standard value $t_{\Delta 0}$, so that the advance time $t_{\Delta 1}$ is earlier than the standard advance time $t_{\Delta 0}$. The lamp 4 is started earlier. The end intensity at the wake-up time $t_{WU}$ is kept equal to the original maximum $I_{M0}$. Thus, the intensity increase rate is lower.

FIG. 3B is a graph comparable to FIG. 2, illustrating the effect of the present invention for a case where the controller 5 finds that the user has had a good night's sleep. The controller 5 changes the duration of the wake-up interval to a value $t_{\Delta 2}$, which is smaller than the standard value $t_{\Delta 0}$, so that the advance time $t_{\Delta 2}$ is later than the standard advance time $t_{\Delta 0}$. The lamp 4 is started later in time. The end intensity at the wake-up time $t_{WU}$ is kept equal to the original maximum $I_{M0}$. Thus, the intensity increase rate is higher.

Figure 4B:
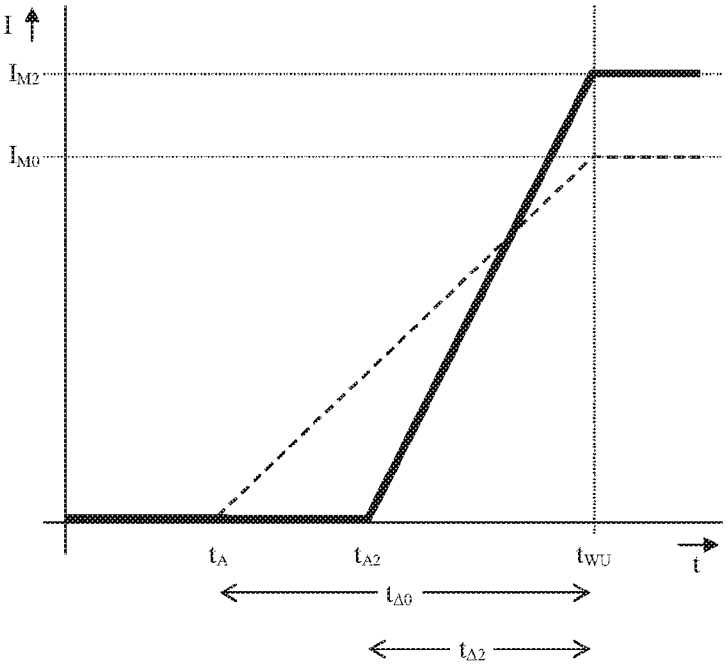
FIGS. 4A and 4B are graphs schematically illustrating amendment of the wake-up interval according to the present invention.
Figure 4A:
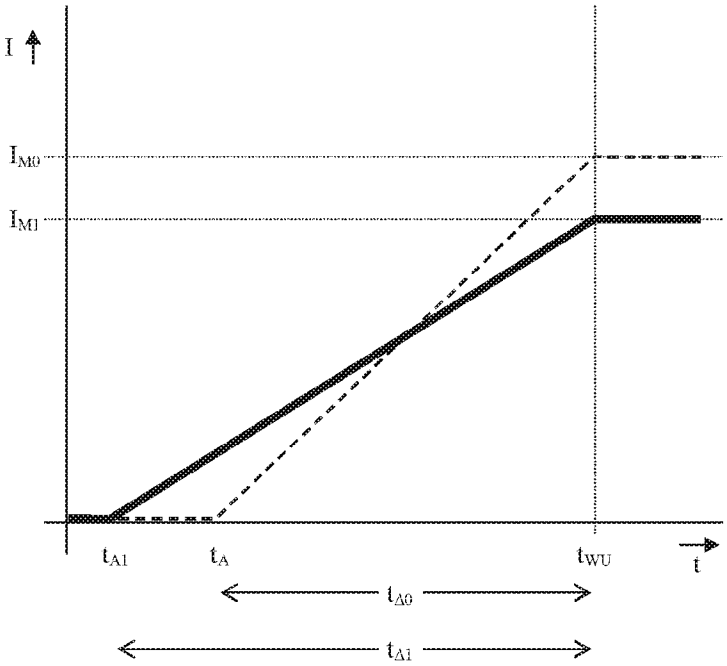

FIG. 4A is a graph comparable to FIG. 3A, illustrating an embodiment where the controller 5, apart from increasing the duration of the wake-up interval, also decreases the end value of the intensity at the wake-up time $t_{WU}$ to a value $I_{M1}$, which is lower than the original maximum $I_{M0}$. This reduces the intensity increase rate even further.

FIG. 4B is a graph comparable to FIG. 3B, illustrating an embodiment where the controller 5, apart from reducing the duration of the wake-up interval, also increases the end value of the intensity at the wake-up time $t_{WU}$ to a value $I_{M2}$, which is higher than the original maximum $I_{M0}$. This increases the intensity increase rate even further.

It is further possible that, for a case where the controller 5 finds that the user has had a good night's sleep, the controller 5 keeps the duration of the wake-up interval equal to the standard value $t_{\Delta 0}$ and only decreases the end value of the intensity at the wake-up time $t_{WU}$ to a value $I_{M1}$, which is lower than the original maximum $I_{M0}$. Conversely, it is further possible that, for a case where the controller 5 finds that the user has had a bad night's sleep, the controller 5 keeps the duration of the wake-up interval equal to the standard value $t_{\Delta 0}$ and only increases the end value of the intensity at the wake-up time $t_{WU}$ to a value $I_{M2}$, which is higher than the original maximum $I_{M0}$.

The sleep quality monitor means 10 may include any device capable of generating a sleep quality monitor signal S indicative of the quality of the user's sleep during the night. According to the invention, a normal or even good night's sleep will involve a sufficient amount of deep sleep, especially during the first half of the night. Therefore, the sleep quality monitor means 10 comprise at least one sensor capable of sensing at least one quantity indicating the actual level of the user's sleep. This level will vary during the night, and the controller 5 calculates the overall sleep quality parameter, or simply "sleep quality", hereinafter indicated as SQ, as a single value on the basis of a plurality of measurements $S(t_i)$ performed at a respective plurality of times $t_i$ during the night.

For monitoring the sleep quality, several quantities may be suitable. Sleep quality can be very accurately determined by measuring brain activity and/or respiratory activity and/or heart activity, but such would involve relatively complicated and/or inconvenient sensors, and furthermore such accuracy is not needed.

In a suitable exemplary embodiment, movements of the user are taken as the quantity to be monitored. On average, persons will move hardly or not at all when they are in deep sleep, while persons tend to move more frequently and more intensely when they are in light sleep. For measuring the user's movements in real time, several types of sensor are suitable, involving mutually different aspects such as in respect of costs and accuracy. It is possible to design the system such that it monitors movements of the user's body as a whole, or such that it monitors individual movements of arms and/or legs. It is possible to employ a remote sensor, for instance an ultrasonic sensor or an infrared sensor, and it is even possible to process images from an infrared camera. It is also possible to employ one or more weight sensors arranged in the user's bed. It is also possible to employ one or more accelerometers to be attached by the user to his body, for instance in the form of a wrist band. Since such sensors are known per se, and the present invention can be implemented using existing movement sensors, and since the invention is not concerned with providing an improved movement sensor, the design and operation of a movement sensor will not be described in greater detail here.

One possible way of calculating the overall sleep quality parameter SQ is to calculate the time-integral of samples $S(t_i)$ of the sensor signal S. However, a better approach is possible which is based on the following considerations.

Figure 5:
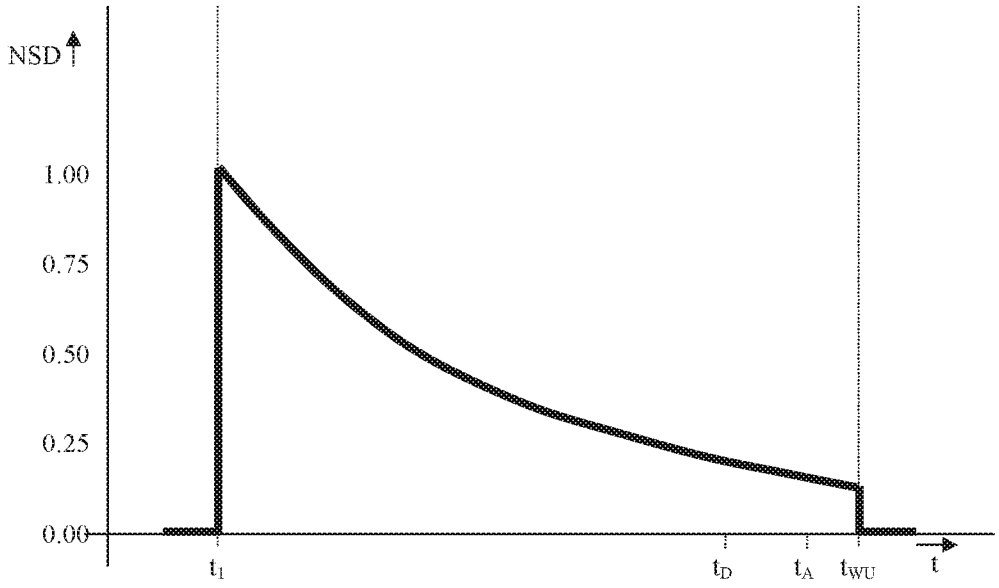
FIG. 5 is a schematic sleep depth curve.

On average, for normally healthy persons, it has been found that deep sleep normally occurs in the first half of the night. Oversimplifying, one might consider that, for a normally healthy person having a normal night's rest, the depth of sleep has a maximum within a short period after the user falls asleep and gradually decreases during the night. FIG. 5 is a schematic sleep depth curve, schematically illustrating normal sleep depth NSD as a function of time t. The horizontal axis represents time t, the vertical axis represents sleep depth NSD in arbitrary units. Time $t_1$ indicates the time when the user intends to go to sleep. It is noted that the wake-up device 1 may be provided by an input or a sensor (not shown for sake of simplicity) for determining this time, hereinafter indicated as "Go To Sleep" time. Such input may be a button to be pressed by the user, or a light sensor detecting that the user switches off the light in the bedroom. In an embodiment where the wake-up device 1 is used as a lamp before the user goes to sleep, the input may be a button for switching off this lamp.

In FIG. 5, NSD(t) is shown as a curved line having a negative first derivative of which the absolute value decreases with time. Alternatively, one may take NSD(t) as a straight line, or another function having a non-positive first derivative. Further, instead of a continuous function, one may take NSD(t) as a stepped function.

Further, on average, for normally healthy persons, it has been found that there is virtually zero motion during episodes of deep sleep. Oversimplifying, one might consider that, for a normally healthy person having a normal night's rest, the absence of movements indicates deep sleep, although in practice there will be of course time intervals where a person who is in a light sleep, or even awake, is nevertheless motionless.

This means that, on average, for normally healthy persons, a normal night's rest will be associated with little or no movements during the initial stage and then an increasing amount of movement towards the end of the night. So, while expecting that a person will move more and more towards the intended wake-up time, it is also expected that such a person will show fewer movements during the initial stage of his sleep. If it is found that a person shows a relatively large amount of movements during the initial stage of his sleep, this may indicate a disturbed sleep in the beginning of the night with insufficient deep sleep, which would negatively affect sleep quality as a whole. In fact, a relatively large amount of movements during the initial stage of his sleep can be considered as a pointer predicting an increased risk of sleep inertia.

In other words, and again oversimplifying, one might say that an ideal night's sleep is characterized by long and/or many periods of deep sleep during the entire night, with virtually no movements. So, the time integral of samples of movement signals should be low. This time integral can obviously not be as low as zero in practice, because this would indicate that the person is still in deep sleep at the intended wake-up time. An increasing value of this time integral can be taken to represent a deteriorating sleep quality, which is more severe as the movements concerned occur earlier in the night.

Figure 6:
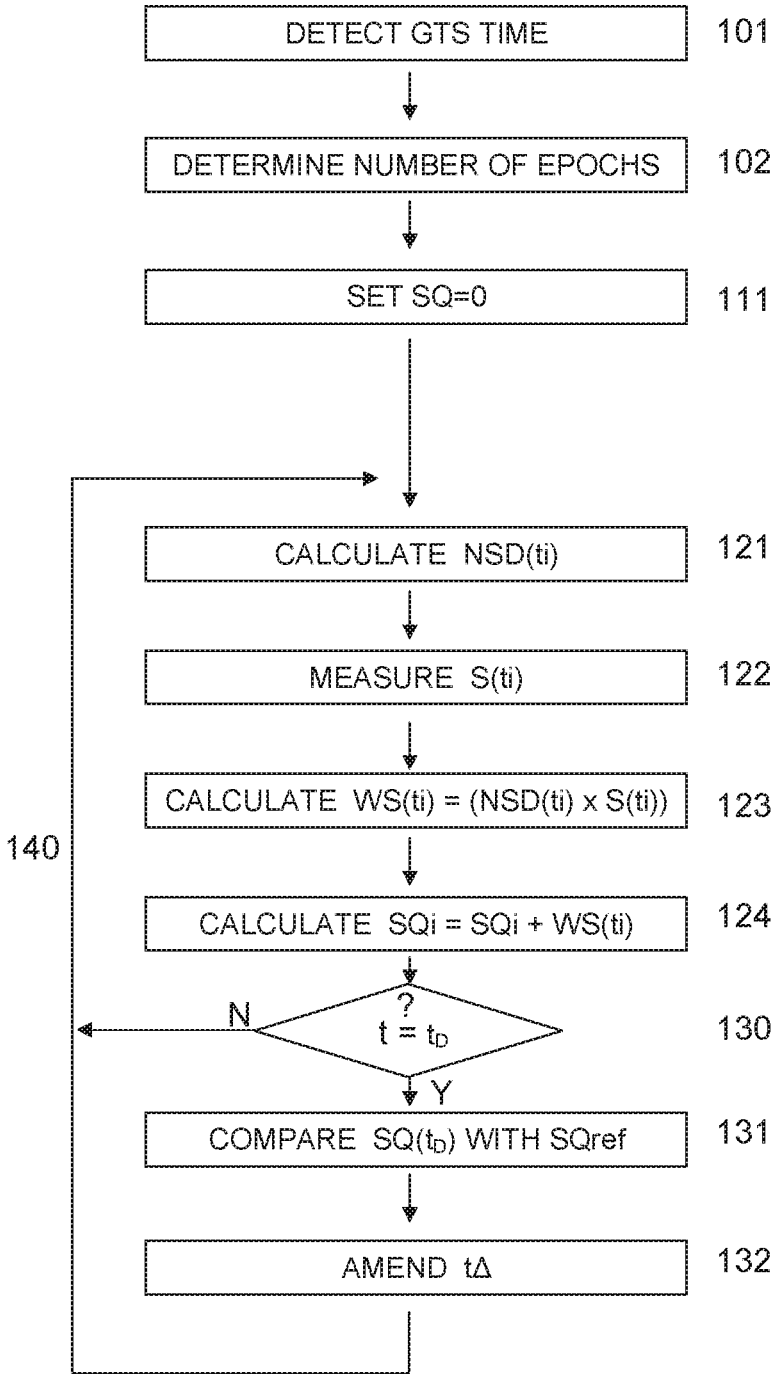
FIG. 6 is a flow diagram schematically illustrating operation of the wake-up device according to the present invention.

Based on the above considerations, with reference to FIG. 6, the overall sleep quality parameter SQ is calculated as follows.

In a first step 101, the controller 5 detects GoToSleep time $t_1$.

The controller 5 is aware of course of the intended wake-up time $t_{WU}$. In a second step 102, the controller divides the time interval (night) between GoToSleep time $t_1$ and intended wake-up time $t_{WU}$ in a large number N of time intervals indicated as "epochs" E. Individual epochs will be indicated by an index i running from 1 to N. Each epoch Ei has a duration Li. Suitably, the number N of epochs may be higher than 100, and may even be in the order of 1000. The number N of epochs may always be the same, in which case the durations Li depend on the GoToSleep time $t_1$ and intended wake-up time $t_{WU}$. Alternatively, the durations Li may always be the same, in which case the number N depends on the GoToSleep time $t_1$ and intended wake-up time $t_{WU}$. The respective epochs Ei may all have the same duration Li, but it is also possible that these durations are mutually different, for instance that they decrease with time. In a preferred embodiment, all epochs Ei have the same duration Li=30 s.

The controller 5 has a memory location for the value of the sleep quality SQ. In an initial stap 111, the controller 5 clears this value.

During an epoch Ei, the controller 5 samples the movement signal S(t), which in a simple embodiment involves counting the number of movements during the epoch Ei (step 121). Further, the controller 5 determines NSD(ti) for this epoch Ei (step 122). To this end, the memory 6 may store a function or a table, or other suitable information, defining NSD(ti) as a function of time or as a function of i. The value NSD(ti) is used as a weighting factor for the measurement sample S(ti) to calculate a weighted measurement sample WS(ti) as WS(ti)=(S(ti)·NSD(ti))/N (step 123). Of course, one may omit the division by N here, and/or one may use a different scaling factor. The weighted measurement sample WS(ti) is added to the sleep quality SQ (step 124).

These steps are repeated for all epochs Ei (step 140).

Thus, at the end of the night, i.e. at the intended wake-up time $t_{WU}$, the sleep quality SQ as calculated satisfies the following formula:

$$SQ = \frac{1}{N}\sum_{i=1}^{N} NSD(t_i)\cdot S(t_i)$$

At a certain predefined decision time $t_D$, earlier than the normal advance time $t_A$, the controller 5 needs to make a decision as to whether or not the wake-up program is to be adapted. If the adaptation only involves one or more parameters of the variable quantities, the decision time $t_D$ may be equal to the normal advance time $t_A$. However, in the preferred embodiment, the adaptation also involves advancing or delaying the advance time $t_A$, so that in such a case the decision time $t_D$ should be earlier than the standard advance time $t_{A0}$, as illustrated in FIG. 5. The decision time $t_D$ should at the latest coincide with the earliest possible value for the shifted advance time $t_{A1}$. A suitable decision time $t_D$ is for instance 1 h before the intended wake-up time $t_{WU}$.

At the end of each epoch Ei, after adding the weighted measurement sample WS(ti) to the sleep quality SQ (step 124), the controller 5 determines (step 130) whether the decision time $t_D$ has been reached. If that is the case, the controller 5 examines the sleep quality SQ calculated so far. It is noted that at that moment the value of a sleep quality decision parameter $SQ(t_D)$ can be expressed in accordance with the following formula:

$$SQ(t_D) = \frac{1}{N}\sum_{t=t_1}^{t_D} NSD(t_i)\cdot S(t_i)$$

To make a decision, the controller 5 has a reference value SQref stored in a memory location, for instance part of the memory 6. In a step 131, the controller 5 compares the value of the sleep quality decision parameter $SQ(t_D)$ calculated at the decision time $t_D$ with the reference value SQref. It is noted that a high value indicates low quality. If the sleep-quality decision parameter $SQ(t_D)$ is considered to be too high, the commencement of the wake-up sequence is advanced, as described earlier. The amount of shifting of the advance time may depend on the absolute or relative difference between $SQ(t_D)$ and SQref.

In step 132, the controller amends the duration of the wake-up interval $t_\Delta$ and possibly the stimulus intensity $I_M$. Several variations are possible.

For instance, it is possible to calculate an amended value $t_{\Delta 1}$ for the wake-up duration by multiplying the standard value $t_{\Delta 0}$ by the factor $SQ(t_D)/SQref$. As a result, the higher the value of $SQ(t_D)$, the longer the duration $t_\Delta$ of the wake-up interval will be.

Or, it is for instance possible to start with the wake-up sequence immediately.

It is possible that the controller 5 makes the decision only once. However, if the controller 5 decides not to advance the start of the wake-up sequence, or to advance the start of the wake-up sequence by a small amount of time only, so that, at the moment of making the decision, the shifted advance time $t_{A1}$ is still in the future, it is also possible that processing continues at step 121. The controller may define a new value for the decision time $t_D$, and when the new decision time $t_D$ is reached, steps 130-132 are again performed, and it is possible that the controller now calculates a different value for the shifted advance time $t_{A1}$. However, this is normally not needed, since the calculated value $SQ(t_D)$ will in practice not change much after the decision time $t_D$.

If, by the time that the new decision time $t_D$ coincides with or is close to the intended wake-up time $t_{WU}$, the sleep-quality decision parameter $SQ(t_D)$ is considered to be relatively low, the commencement of the wake-up sequence is delayed, as described earlier.

The reference value SQref for the sleep quality decision parameter may be a fixed, predetermined value, and in fact, this may be the case in the out-of-the-box situation. However, different persons may have different values for "normal". Therefore, the controller 5 preferably has a learning capability in that the reference value SQref is adapted to the personal circumstances of the user. To do this, the controller may store the most recent values obtained for $SQ(t_D)$ or SQ, for instance the last 10 or 20 values. Each time the user starts the apparatus for a new night's sleep, SQref is calculated as an average of the overall sleep quality parameters SQ or sleep quality decision parameters $SQ(t_D)$ calculated during a predefined number of previous monitoring sessions stored. At the end of the night, the newly calculated value for $SQ(t_D)$ or SQ, respectively, is added to the memory, while the oldest one is discarded. Thus, the reference value SQref is a running average of historically obtained results.

The device may be provided with a user input button, allowing the user to indicate whether he considers the recent night to be an abnormally bad night: in such a case, the newly calculated value for $SQ(t_D)$ or SQ is discarded. Also, the controller may examine automatically whether the newly calculated value for $SQ(t_D)$ or SQ deviates to an abnormally large degree from the current average, and may in such a case decide to automatically discard the newly calculated value for $SQ(t_D)$ or SQ.

Summarizing, the present invention provides a wake-up device 1 comprising clock means 2, wake-up timer means 3, controllable wake-up stimulus means 4, and a control device 5 for controlling the wake-up stimulus means 4.

The wake-up stimulus means is capable of varying an intensity of the wake-up stimulus.

The wake-up stimulus is started at a relatively low intensity at a predetermined advance time $t_A$ before the intended time of wakingup $t_{WU}$, in such a manner that the intensity of the wake-up stimulus is gradually increased in accordance with a predefined wake-up program.

The wake-up device further comprises sleep quality monitor means 10 for monitoring the quality of the sleep of a user, and for generating a sleep quality monitor signal S indicative of the quality of the sleep of the user.

The control device is responsive to the sleep quality monitor signal S received from the sleep quality monitor means to amend the wake-up program.

While the invention has been illustrated and described in detail in the drawings and in the foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appended claims.

For instance, in the discussed embodiment, the wake-up stimulus is light. This indeed is a preferred stimulus, but other types of stimulus are also possible. In fact, any type of stimulus that the user can sense can be used in the present invention. Such a stimulus may involve for instance sound (to be heard), odor (to be smelled), vibrations (to be felt). Combinations of different types of stimulus are also possible.

In a typical embodiment, the alarm signal will be a sound signal. It is possible that the wake-up stimulus also is a sound signal, slowly increasing in amplitude. In such an embodiment, it may be that the stimulus device 4 and the alarm device 7 are implemented by one and the same sound-generating device.

Further, in the discussed embodiment, apart from the "duration of wake-up interval" (and thus "starting time"), only the variable quantity "intensity" has been discussed as a quantity whose value is varied during the wake-up interval. The stimulus applied may have more such quantities. For instance, in the case of light, the color may be a quantity to be varied from an initial value to an end value, i.e. the value at the wake-up time $t_{WU}$. In this case, the initial color and/or the end color may be adapted in response to the sleep quality. In the case of a sound stimulus, the frequency may be a quantity to be varied from an initial value to an end value. In any case, whatever the quantity, the initial value will be a value having a relatively low wake-up stimulating effect and the end value will be a value having a relatively high wake-up stimulating effect. According to the invention, the starting time of the wake-up period may be adapted, and/or the initial value of a stimulus parameter may be adapted, and/or the end value of a stimulus parameter may be adapted.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. Even if certain features are recited in different, dependent claims, the present invention also relates to an embodiment in which all these features are simultaneously present. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such a functional block is performed by individual hardware components, but it is also possible that one or more of these functional blocks are implemented in software, so that the function of such a functional block is performed by one or more program lines of a computer program or a programmable device such as a microprocessor, microcontroller, digital signal processor, etc.

The invention claimed is:

1. Wake-up device comprising:

clock means for generating an actual time signal corresponding to an actual time of day;

wake-up timer means for generating a wake-up time signal corresponding to an intended time of waking up;

controllable wake-up stimulus means for generating at least one wake-up stimulus for causing a user to wake up, the wake-up stimulus having at least one variable stimulus quantity, wherein a wake-up effectiveness of the wake-up stimulus depends on a value of the stimulus quantity;

a control device having inputs coupled to receive the actual time signal and the wake-up time signal and adapted to generate a control signal for controlling the wake-up stimulus means;

wherein the wake-up stimulus means is responsive to said control signal to vary the value of said stimulus quantity;

and wherein the control device is adapted to generate the control signal such that the wake-up stimulus is generated in accordance with a predefined wake-up program, the wake-up program including:

a) an initial value for the stimulus quantity of the wake-up stimulus, the initial value having a relatively low wake-up effectiveness;

b) an end value ($I_M$) for the stimulus quantity of the wake-up stimulus, the end value having a relatively high wake-up effectiveness;

c) a wake-up duration ($t_\Delta$), defining an advance time ($t_A$) before the intended time of waking-up ($t_{WU}$) according to the formula $t_A=t_{WU}-t_\Delta$;

d) wherein, at the advance time ($t_A$), the wake-up stimulus is started with the said stimulus quantity having said initial value;

e) wherein, in a time interval from the advance time ($t_A$) until the intended time of waking-up ($t_{WU}$), the value of said stimulus quantity is gradually varied from said initial value to said end value;

f) wherein, at the intended time of waking-up ($t_{WU}$), said stimulus quantity has said end value;

wherein the wake-up device further comprises sleep quality monitor means for monitoring a quality of the sleep of a user and for generating a sleep quality monitor signal (S) indicative of the momentary quality of sleep of the user;

and wherein the control device has an input to detect a go to sleep time of the user before the advance time, and in that the control device is responsive to the sleep quality monitor signal (S) received from the sleep quality monitor means to calculate an overall sleep quality parameter (SQ) of the user on the basis of a plurality of measurements of the sleep quality monitor signal performed at a respective plurality of times between the go to sleep time and the advance time, and to amend the wake-up program as a function of the overall sleep quality parameter (SQ).

2. Wake-up device according to claim 1, further comprising a memory associated with the control device, which memory contains information defining at least one program parameter of the wake-up program, and wherein the control device is responsive to the sleep quality monitor signal (S) to amend the value of the program parameter as a function of the overall sleep quality parameter (SQ).

3. Wake-up device according to claim 2, wherein the program parameter to be amended as a function of the overall sleep quality parameter (SQ) is said initial value and/or said end value and/or said wake-up duration.

4. Wake-up device according to claim 2, wherein the memory contains a standard time value ($t_{\Delta 0}$) for the wake-up duration ($t_\Delta$), and wherein the control device is responsive to the sleep quality monitor signal (S) to increase the wake-up duration ($t_\Delta$) to a value ($t_{\Delta 1}$) higher than the standard time value ($t_{\Delta 0}$) when the overall sleep quality parameter (SQ) corresponds to a bad night's sleep of the user.

5. Wake-up device according to claim 2, wherein the memory contains a standard time value ($t_{\Delta 0}$) for the wake-up duration ($t_\Delta$), and wherein the control device is responsive to the sleep quality monitor signal (S) to reduce the wake-up duration ($t_\Delta$) to a value ($t_{\Delta 2}$) lower than the standard time value ($t_{\Delta 0}$) when the overall sleep quality parameter (SQ) corresponds to a good night's sleep of the user.

6. Wake-up device according to claim 2, wherein the memory contains a standard stimulus value ($I_{M0}$) for the end value of said variable stimulus quantity of the wake-up stimulus, and wherein the control device is responsive to the sleep quality monitor signal (S) to reduce said end value to a value ($I_{M1}$) lower than the standard stimulus value ($I_{M0}$) when the overall sleep quality parameter (SQ) corresponds to a bad night's sleep of the user.

7. Wake-up device according to claim 2, wherein the memory contains a standard stimulus value ($I_{M0}$) for the end value of said variable stimulus quantity of the wake-up stimulus, and wherein the control device is responsive to the sleep quality monitor signal (S) to increase said end value to a value ($I_{M2}$) higher than the standard stimulus value ($I_{M0}$) when the overall sleep quality parameter (SQ) corresponds to a good night's sleep of the user.

8. Wake-up device according to claim 1, wherein the wake-up stimulus is light.

9. Wake-up device according to claim 1, wherein said variable stimulus quantity of the wake-up stimulus is a stimulus intensity.

10. Wake-up device according to claim 1, wherein the sleep quality monitor means include a movement sensor for detecting-body movement of the user, and wherein the sleep quality monitor means are configured for generating the sleep quality monitor signal (S), based on the amount of body movement of the user.

11. Wake-up device according to claim 2, wherein the memory contains information defining a weighting function (NSD(t)) as a function of time or as a function of epoch ($E_i$) during the night, the weighting function (NSD(t)) having higher weighting values in earlier stages of the night and lower weighting values in later stages of the night.

12. Wake-up device according to claim 2, wherein the sleep quality monitor means include a movement sensor for detecting body movement of the user, and wherein the sleep quality monitor means are configured for generating the sleep quality monitor signal (S), based on the amount of body movement of the user;

wherein the control device is configured to divide a sleep time interval between an intended moment of going to sleep and an intended moment of waking up into a plurality (N) of epochs ($E_i$);

wherein the memory contains information defining a weighting function ($NSD(t_i)$) as a function of said epochs ($E_i$), the weighting function ($NSD(t_i)$) having higher weighting values in earlier stages of the sleep time interval and lower weighting values in later stages of the sleep time interval;

wherein the control device is configured for each epoch ($E_i$) to calculate a weighted measurement sample ($WS(t_i)$) according to the formula $WS(t_i)=(S(t_i)\cdot NSD(t_i))/N$, wherein $S(t_i)$ indicates the sampled value of the sleep quality monitor signal (S) in the epoch ($E_i$);

and wherein the control device is configured to calculate the overall sleep quality parameter (SQ) as the running summation of the weighted measurement samples ($WS(t_i)$) according to the formula $$SQ = \sum_{i=1}^{N} WS(t_i) = \frac{1}{N}\sum_{i=1}^{N} NSD(t_i)\cdot S(t_i)$$

13. Wake-up device according to claim 12, wherein, at a predefined decision time ($t_D$), earlier than a standard advance time ($t_{A0}$), the control device increases the wake-up duration ($t_A$) if at that time the control device finds that a sleep quality decision parameter ($SQ(t_D)$) calculated as:

$$SQ(t_D) = \frac{1}{N}\sum_{t=t_1}^{t_D} NSD(t_i)\cdot S(t_i)$$

is higher than a reference value ($SQ_{ref}$) stored in the memory.

14. Wake-up device according to claim 13, wherein the reference value ($SQ_{ref}$) is a running average of overall sleep quality parameters or sleep quality decision parameters calculated during a predefined number of previous monitoring sessions.

15. Wake-up device according to claim 1, wherein the wake-up stimulus means comprises a wake-up lamp with a variable light intensity.

* * * * *